US012667157B2

(12) United States Patent
Kim et al.

(10) Patent No.: US 12,667,157 B2
(45) Date of Patent: Jun. 30, 2026

(54) CHIN GUARD PIVOTING MECHANISM

(71) Applicant: HJC CORP., Gyeonggi-do (KR)

(72) Inventors: Sung Kwang Kim, Gyeonggi-do (KR); Jung Hyun Jo, Seoul (KR)

(73) Assignee: HJC CORP., Gyeonggi-do (KR)

( * ) Notice: Subject to any disclaimer, the term of this patent is extended or adjusted under 35 U.S.C. 154(b) by 0 days.

(21) Appl. No.: 18/848,012

(22) PCT Filed: Jan. 19, 2023

(86) PCT No.: PCT/KR2023/000908

§ 371 (c)(1),
(2) Date: Sep. 17, 2024

(87) PCT Pub. No.: WO2023/182633

PCT Pub. Date: Sep. 28, 2023

(65) Prior Publication Data

US 2025/0194730 A1 Jun. 19, 2025

(30) Foreign Application Priority Data

Mar. 22, 2022 (KR) ..... 10-2022-0035450

(51) Int. Cl.
*A42B 3/32* (2006.01)
*A42B 3/20* (2006.01)
*A42B 3/22* (2006.01)

(52) U.S. Cl.
CPC ..... *A42B 3/326* (2013.01); *A42B 3/205* (2013.01); *A42B 3/222* (2013.01)

(58) Field of Classification Search
CPC ..... A42B 3/326; A42B 3/205; A42B 3/222
See application file for complete search history.

(56) References Cited

U.S. PATENT DOCUMENTS 4,312,078 A * 1/1982 Pollitt ..... A42B 3/222 2/10
4,748,696 A * 6/1988 Fohl ..... A42B 3/223 2/10
5,062,162 A * 11/1991 Kamata ..... A42B 3/222 2/424
5,182,816 A * 2/1993 Arai ..... A42B 3/222 2/424
5,987,651 A * 11/1999 Tanaka ..... A42B 3/223 2/424

(Continued)

FOREIGN PATENT DOCUMENTS

CN 2896942 Y * 5/2007
KR 10-1253491 4/2013

(Continued)

*Primary Examiner* — Khaled Annis
(74) *Attorney, Agent, or Firm* — DUANE MORRIS LLP; Gregory M. Lefkowitz; Daniel J. Tarr

(57) ABSTRACT

The present disclosure relates to a chin guard pivoting mechanism. The chin guard pivoting mechanism according to the present disclosure is provided in a helmet including a helmet body (10) and a chin guard (20) pivotally coupled to the helmet body (10), wherein while two connectors (100, 200) provided in the chin guard (20) move along two guide parts (300, 400), the chin guard (20) is pivoted, and at least one (400) of the two guide parts (300, 400) extends from the front to the rear.

6 Claims, 11 Drawing Sheets

(56) References Cited

U.S. PATENT DOCUMENTS 6,047,409 A * 4/2000 Simpson ..... A42B 3/223 2/424
6,249,918 B1 * 6/2001 Lacroix ..... A42B 3/226 2/424
6,442,766 B1 * 9/2002 Arai ..... A42B 3/222 2/424
6,598,238 B2 * 7/2003 Hong ..... A42B 3/326 2/424
6,622,314 B1 * 9/2003 Kim ..... A42B 3/222 2/424
7,814,579 B2 * 10/2010 Dion ..... A42B 3/326 2/410
8,082,600 B2 * 12/2011 Morin ..... A42B 3/326 2/424
8,161,577 B2 * 4/2012 Tews ..... A42B 3/223 2/424
8,166,576 B2 * 5/2012 Kato ..... A42B 3/223 2/424
8,375,474 B2 * 2/2013 Arai ..... A42B 3/222 2/9
10,278,446 B2 * 5/2019 Arai ..... A42B 3/227
11,412,807 B2 * 8/2022 Jwa ..... A42B 3/205
11,844,389 B2 * 12/2023 Huang ..... A42B 3/223
11,903,438 B2 * 2/2024 Guazzerotti ..... A42B 3/222
2002/0129440 A1 * 9/2002 Hong ..... A42B 3/326 2/422
2002/0189005 A1 * 12/2002 Taniuchi ..... A42B 3/223 2/424
2004/0019956 A1 * 2/2004 Arai ..... A42B 3/283 2/410
2005/0273912 A1 * 12/2005 Gafforio ..... A42B 3/226 2/424
2006/0064799 A1 * 3/2006 Dion ..... A42B 3/326 2/424
2007/0124851 A1 * 6/2007 Pyo ..... A42B 3/222 2/424
2008/0196148 A1 * 8/2008 Morin ..... A42B 3/222 2/10
2009/0183302 A1 * 7/2009 Choi ..... A42B 3/222 2/424
2009/0288242 A1 * 11/2009 Kato ..... A42B 3/223 24/604
2011/0056002 A1 * 3/2011 Lee ..... A42B 3/222 2/424
2011/0094019 A1 * 4/2011 Isobe ..... A42B 3/222 2/424
2011/0302701 A1 * 12/2011 Kuo ..... A42B 3/326 2/424
2012/0284906 A1 * 11/2012 Kuo ..... A42B 3/223 2/424
2013/0081199 A1 * 4/2013 Nimura ..... A42B 3/221 2/421
2013/0191976 A1 * 8/2013 Pizzi ..... A42B 3/223 2/424
2013/0340148 A1 12/2013 Arai
2015/0059069 A1 * 3/2015 Arai ..... A42B 3/222 2/424
2016/0015114 A1 * 1/2016 Berthier ..... A42B 3/222 2/424
2018/0103710 A1 * 4/2018 Kim ..... A42B 3/326
2019/0045875 A1 2/2019 Bryant
2021/0274877 A1 9/2021 Liao
2022/0071334 A1 * 3/2022 Huang ..... A42B 3/223
2022/0408868 A1 * 12/2022 Isobe ..... A42B 3/223
2023/0292875 A1 * 9/2023 Guazzerotti ..... A42B 3/222 2/427
2024/0081463 A1 * 3/2024 Lee ..... A42B 3/222

FOREIGN PATENT DOCUMENTS

WO WO-2022173097 A1 * 8/2022 ..... A42B 3/205
WO WO-2023191281 A1 * 10/2023 ..... A42B 3/20
WO WO-2023214720 A1 * 11/2023 ..... A42B 3/20

* cited by examiner

CHIN GUARD PIVOTING MECHANISM

CROSS-REFERENCE TO RELATED APPLICATIONS

This application is a § 371 national stage entry of International Application No. PCT/KR2023/000908, filed on Jan. 19, 2023, which claims priority to Korean Patent Application No. 10-2022-0035450, filed on Mar. 22, 2022, the entire contents of which are incorporated herein by reference.

TECHNICAL FIELD

The present disclosure relates to a chin guard pivoting mechanism.

BACKGROUND ART

In general, it is mandatory to wear a helmet while driving a two wheeled vehicle with high speed to protect the wearer's head. The helmet has a front open portion to ensure the wearer's frontal field of view. The helmet may include a shield that can selectively open and close the open portion to keep out wind, dust, etc. while driving. Meanwhile, the conventional helmet includes a chin guard to protect the wearer's chin as disclosed in the patent literature of the related literatures described below. In this instance, the chin guard may pivot between a closed position and an open position. However, when the chin guard pivots to the open position, the chin guard is disposed far away from the helmet. As described above, when the chin guard is disposed far away from the helmet, the center of mass is concentrated at the front side, or drag increases.

RELATED LITERATURES

Patent Literature (Patent Literature 1) KR10-2014-0001141 A

DISCLOSURE

Technical Problem

The present disclosure is designed to solve the above-described problem, and therefore an aspect of the present disclosure relates to a chin guard pivoting mechanism by which a chin guard may be disposed as close to a helmet body as possible when the chin guard pivots to an open position.

Technical Solution

A chin guard pivoting mechanism according to an embodiment of the present disclosure is provided in a helmet including a helmet body and a chin guard pivotably coupled to the helmet body, and as two connection portions disposed in the chin guard moves along two guide portions, the chin guard pivots, and at least one of the two guide portions is extended from the front to the rear.

Additionally, in the chin guard pivoting mechanism according to an embodiment of the present disclosure, the two connection portions include a first connection portion disposed in the chin guard, and a second connection portion disposed in the chin guard, and the two guide portions include a first guide portion disposed in the helmet body, and configured to guide the movement of the first connection portion when the chin guard pivots, and a second guide portion disposed in the helmet body, and configured to guide the movement of the second connection portion when the chin guard pivots.

Additionally, in the chin guard pivoting mechanism according to an embodiment of the present disclosure, each of the two guide portions is extended in an arc shape.

Additionally, in the chin guard pivoting mechanism according to an embodiment of the present disclosure, the first guide portion is disposed at a front position compared to the second guide portion.

Additionally, in the chin guard pivoting mechanism according to an embodiment of the present disclosure, when the chin guard pivots, a distance at which the first connection portion moves along the first guide portion is larger than a distance at which the second connection portion moves along the second guide portion.

Additionally, in the chin guard pivoting mechanism according to an embodiment of the present disclosure, when the first guide portion includes a first end and a second end, and the second guide portion includes a third end and a fourth end, the first end is disposed at a low position compared to the second end, and the third end is disposed at a front position compared to the fourth end, and when the first connection portion moves from the first end to the second end, the second connection portion moves from the third end to the fourth end.

Additionally, in the chin guard pivoting mechanism according to an embodiment of the present disclosure, the third end is disposed closer to the second end than the first end.

Additionally, in the chin guard pivoting mechanism according to an embodiment of the present disclosure, the first guide portion is formed in an arc shape that extends frontward and then rearward from the first end to the second end, and the second guide portion is formed in an arc shape that extends upward and then downward from the third end to the fourth end.

Additionally, the chin guard pivoting mechanism according to an embodiment of the present disclosure further includes a force providing portion configured to provide at least one of the two connection portions with a force toward an end of at least one of the two guide portions when the at least one of the two connection portions moves along the at least one of the two guide portions.

Additionally, in the chin guard pivoting mechanism according to an embodiment of the present disclosure, the force providing portion includes a pivoting means having one side to which the at least one of the two connection portions is coupled, and pivoting with respect to the other side, and a force providing means configured to provide the force to the pivoting means so that one side of the pivoting means pivots toward the end of the at least one of the two guide portions.

Additionally, in the chin guard pivoting mechanism according to an embodiment of the present disclosure, the force providing means includes a third connection portion disposed in the pivoting means, a third guide portion configured to guide the movement of the third connection portion when the pivoting means pivots, a movement portion coupled to the other side of the pivoting means and configured to move so that a distance to the third guide portion changes, and an elastic portion configured to provide an elastic force to the movement portion in a direction of getting closer to the third guide portion.

Additionally, in the chin guard pivoting mechanism according to an embodiment of the present disclosure, the other side of the pivoting means is closer to the third guide portion than a center of curvature of the third guide portion.

The features and advantages of the present disclosure will be apparent from the following detailed description in accordance with the accompanying drawings.

Prior to the description, it should be understood that the terms or words used in the specification and the appended claims should not be construed as limited to general and dictionary meanings, but rather interpreted based on the meanings and concepts corresponding to the technical spirit of the present disclosure on the basis of the principle that the inventor is allowed to define terms appropriately for the best explanation.

Advantageous Effects

According to the present disclosure, when the chin guard pivots to the open position, the chin guard is disposed as close to the helmet body as possible, thereby minimizing the disadvantage that the center of mass is concentrated at the front side and drag increases.

BEST MODE

Figure 1:
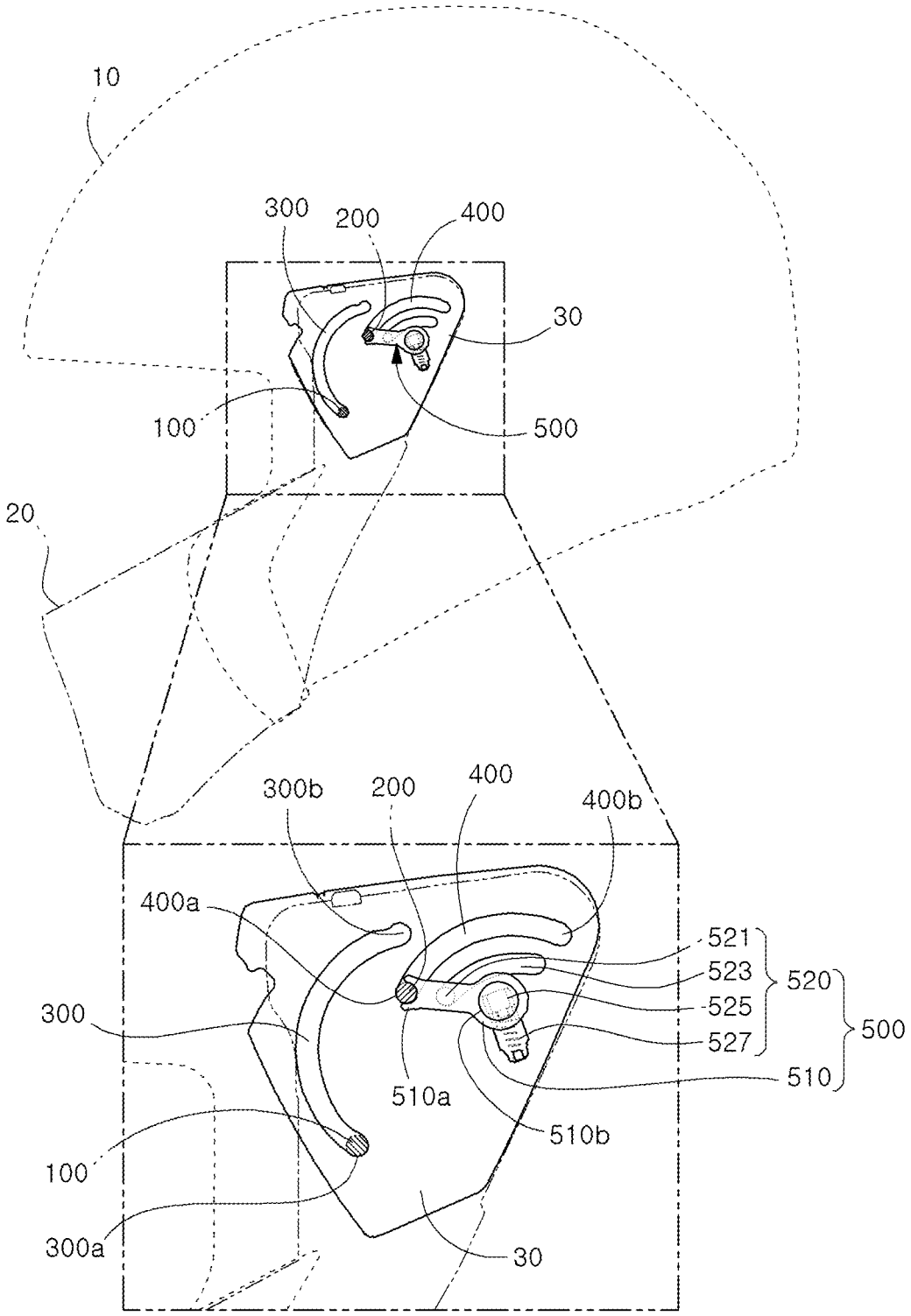
FIGS. 1 to 5 are side views showing an operation process of a chin guard pivoting mechanism according to an embodiment of the present disclosure.

The objectives, particular advantages and new features of the present disclosure will be apparent from the following detailed description and exemplary embodiments in association with the accompanying drawings. In affixing the reference numbers to the elements of each drawing in the present disclosure, it should be noted that identical elements are given as identical numbers as possible although they are depicted in different drawings. Additionally, the terms such as "first", "second" or the like are used to distinguish one element from another, and the elements are not limited by the terms. Hereinafter, in describing the present disclosure, when it is determined that a certain description of related known technology may unnecessarily obscure the subject matter of the present disclosure, the detailed description is omitted.

Hereinafter, exemplary embodiments of the present disclosure will be described in detail with reference to the accompanying drawings.

FIGS. 1 to 5 are side views showing an operation process of a chin guard pivoting mechanism according to an embodiment of the present disclosure.

As shown in FIGS. 1 to 5, the chin guard pivoting mechanism according to this embodiment is provided in a helmet including a helmet body 10 and a chin guard 20 pivotably coupled to the helmet body 10, and as two connection portions 100, 200 disposed in the chin guard 20 move along two guide portions 300, 400, the chin guard 20 pivots, and at least one guide portion 400 of the two guide portions 300, 400 is extended from the front to the rear.

Basically, the helmet body 10 plays a role in protecting a wearer's head. The helmet body 10 may be made of a shock absorbing material. For example, the helmet body 10 may include an outer shell of hard synthetic resin and having high strength, and an absorber disposed in the outer shell, made of an expanded polystyrene (EPS) foam and having proper strength and elasticity. A pad may be present inside the absorber to improve a snug fit.

Additionally, the chin guard 20 plays a role in protecting the wearer's chin, and may be extended in such an arc shape as a whole that it is disposed in front of the wearer's chin. In this instance, the chin guard 20 is pivotable from a first predetermined position to a second predetermined position with two ends pivotably coupled to a ratchet portion 30 disposed at two sides of the helmet body 10. For example, the first predetermined position refers to a closed position when the chin guard 20 is disposed in front of the wearer's chin (see FIG. 1), and the second predetermined position refers to an open position when the chin guard 20 is disposed above the helmet body 10 (see FIG. 5, the chin guard 20 is open). However, the chin guard 20 is not limited merely to be pivotable from the first predetermined position (in front of the wearer's chin) to the second predetermined position (above the helmet body 10), and may pivot to the rear side of the helmet body 10.

As described above, when the chin guard 20 pivots from the closed position to the open position, as the chin guard 20 pivots around a pivot axis, the chin guard 20 may be disposed far away from the helmet body 10. However, according to the chin guard mechanism according to this embodiment, as the two connection portions 100, 200 disposed in the chin guard 20 move along the two guide portions 300, 400, the chin guard 20 pivots, and at least one guide portion (the second guide portion 400) of the two guide portions 300, 400 is extended rearward. Specifically, because at least one guide portion (the second guide portion 400) of the two guide portions 300, 400 is extended from the front to the rear, as the chin guard 20 pivots, at least one connection portion (the second connection portion 200) of the two connection portions 100, 200 moves rearward along at least one guide portion (the second guide portion 400) of the two guide portions 300, 400, and thus the chin guard 20 may be disposed as close to the helmet body 10 as possible when the chin guard 20 is in the open position.

The chin guard pivoting mechanism that controls the pivoting of the chin guard 20 includes the two connection portions 100, 200 and the two guide portions 300, 400, and here, the two connection portions 100, 200 may include first and second connection portions 100, 200, and the two guide portions 300, 400 may include first and second guide portions 300, 400. Specifically, each of the first and second connection portions 100, 200 may be disposed in the chin guard 20, and the first connection portion 100 may be disposed at a front position compared to the second connection portion 200. Here, the first and second connection portions 100, 200 may be disposed at two ends of the chin guard 20, respectively, and may be formed in the shape of a protrusion that protrudes from the inner surface of the chin guard 20. For example, the first and second connection portions 100, 200 may be a protruding pin coupled to the chin guard 20. Additionally, each of the first and second guide portions 300, 400 may be disposed in the helmet body 10, and the first guide portion 300 may guide the movement of the first connection portion 100 and may be extended from the lower side to the upper side. Additionally, the second guide portion 400 may guide the movement of the second connection portion 200, and may be extend from the front to the rear. For example, the first and second guide portions 300, 400 may be formed in the shape of a slit that extends along the ratchet portion 30 of the helmet body 10. Accordingly, when the chin guard 20 pivots, the first connection portion 100 disposed in the chin guard 20 may be inserted into the first guide portion 300 and slidably move along the first guide portion 300, and at the same time, the second connection portion 200 disposed in the chin guard 20 may be inserted into the second guide portion 400 and slidably move along the second guide portion 400.

More specifically, each of the first and second guide portions 300, 400 may be extended in an arc shape having a curvature. In this instance, the first and second guide portions 300, 400 may have different curvatures or the same curvature. Additionally, the first guide portion 300 may be disposed in front of the second guide portion 400, and the first guide portion 300 may be longer than the second guide portion 400.

Additionally, the first guide portion 300 may include a first end 300*a* and a second end 300*b*, and the first end 300*a* may be disposed at a low position compared to the second end 300*b*. That is, the first end 300*a* may be disposed at the lower end of the first guide portion 300, and the second end 300*b* may be disposed at the upper end of the first guide portion 300. In this instance, the first guide portion 300 may be formed in an arc shape that extends frontward and then rearward as it goes from the first end 300*a* (lower end) to the second end 300*b* (upper end). Additionally, the second guide portion 400 may include a third end 400*a* and a fourth end 400*b*, and the third end 400*a* may be disposed at a front position compared to the fourth end 400*b*. That is, the third end 400*a* may be disposed at the front end of the second guide portion 400, and the fourth end 400*b* may be disposed at the rear end of the second guide portion 400. In this instance, the second guide portion 400 may be formed in an arc shape that extends upward and then downward as it goes from the third end 400*a* (front end) to the fourth end 400*b* (rear end). As a whole, as the chin guard 20 pivots, the first connection portion 100 may move from the first end 300*a* to the second end 300*b* of the first guide portion 300, and at the same time, the second connection portion 200 may move from the third end 400*a* to the fourth end 400*b* of the second guide portion 400. On the other hand, the third end 400*a* of the second guide portion 400 may be disposed closer to the second end 300*b* than the first end 300*a* of the first guide portion 300. That is, the second guide portion 400 may be disposed at a relatively upper position (close to the second end 300*b* of the first guide portion 300) when viewed on the basis of the first guide portion 300.

Below is a description of the movement of the first and second connection portions 100, 200 disposed in the chin guard 20 along the first and second guide portions 300, 400 while the chin guard 20 pivots.

To begin with, as shown in FIG. 1, when the chin guard 20 is disposed at the closed position, the first connection portion 100 may be disposed at the first end 300*a* of the first guide portion 300, and the second connection portion 200 may be disposed at the third end 400*a* of the second guide portion 400.

Figure 2:
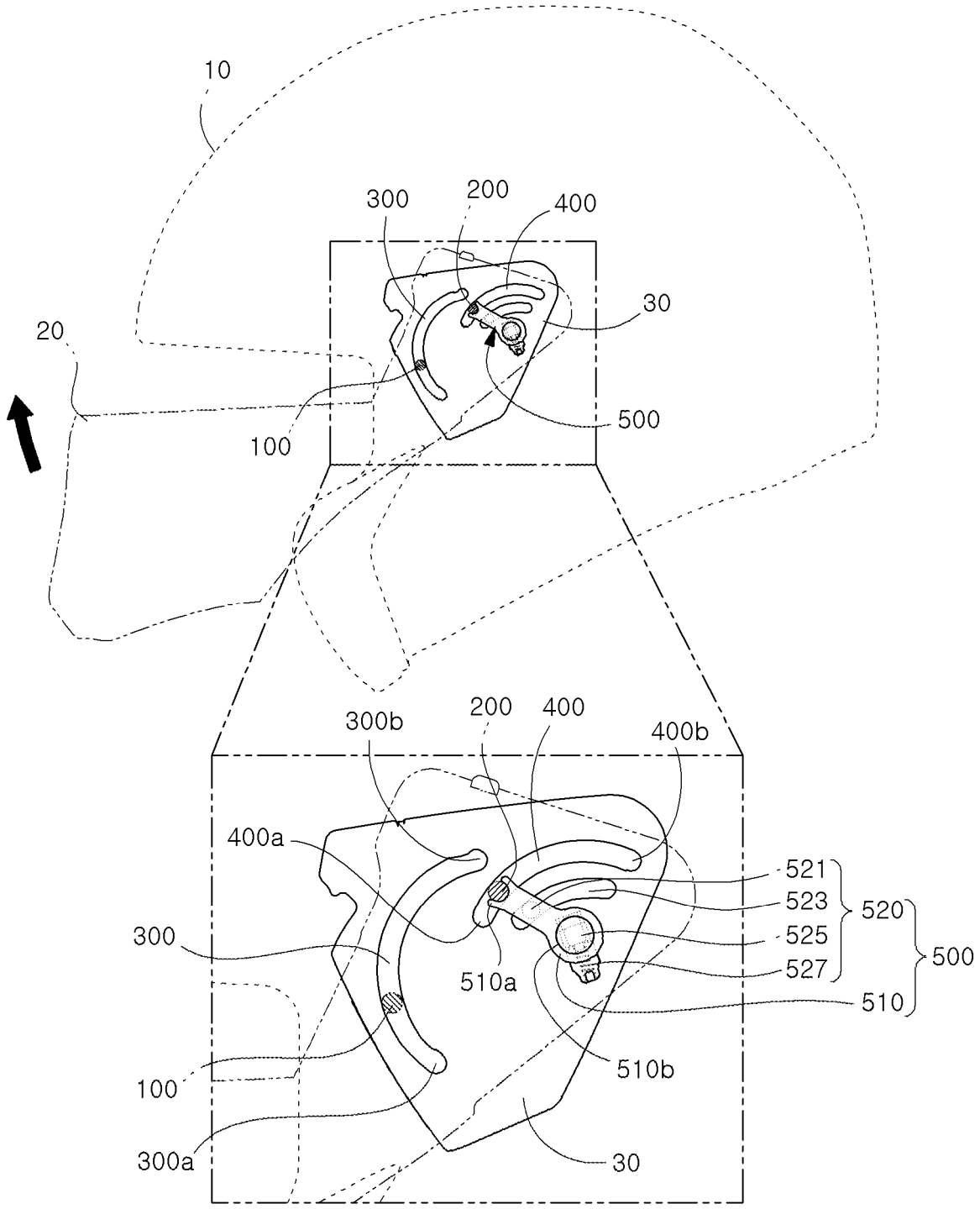
Figure 3:
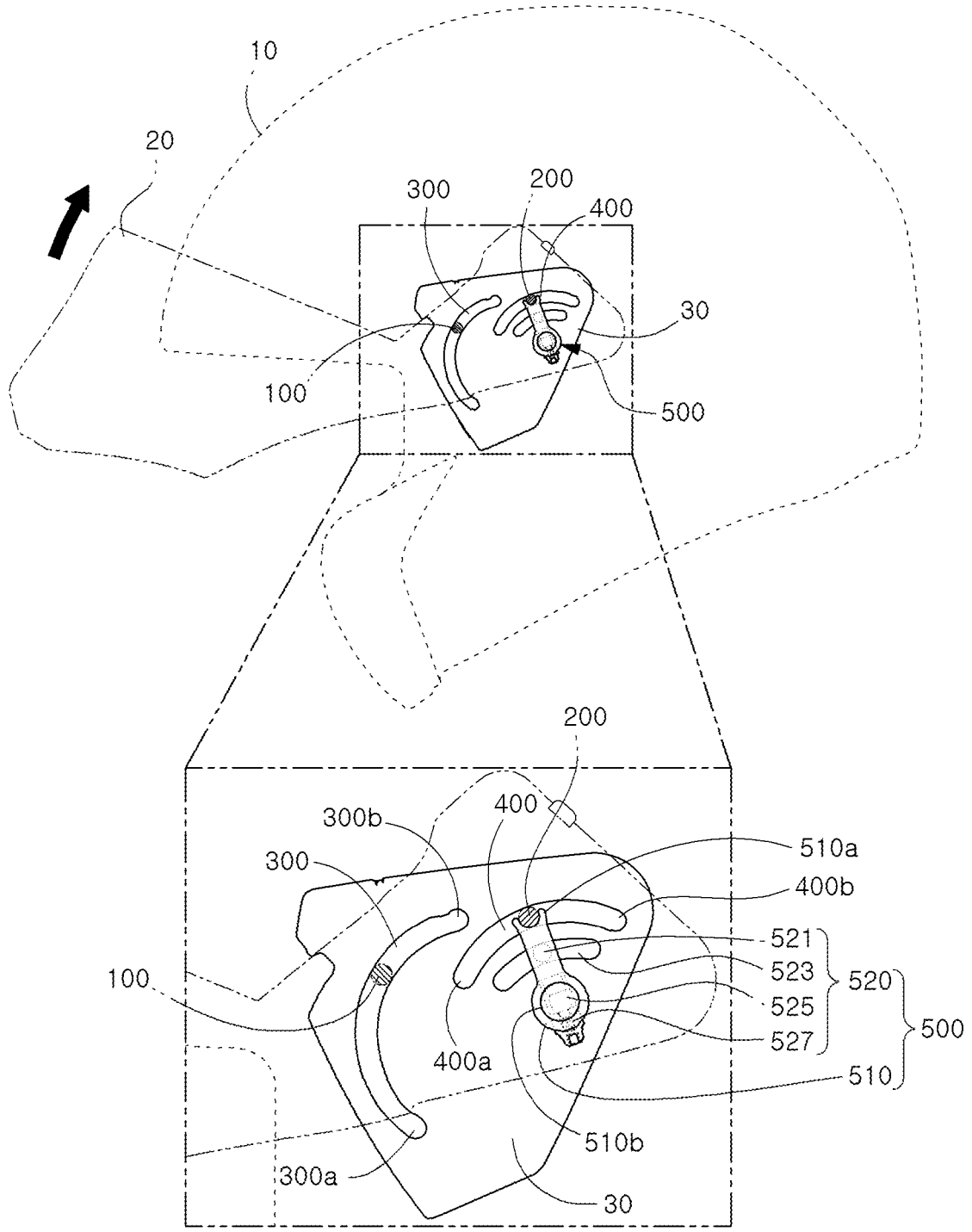
Figure 4:
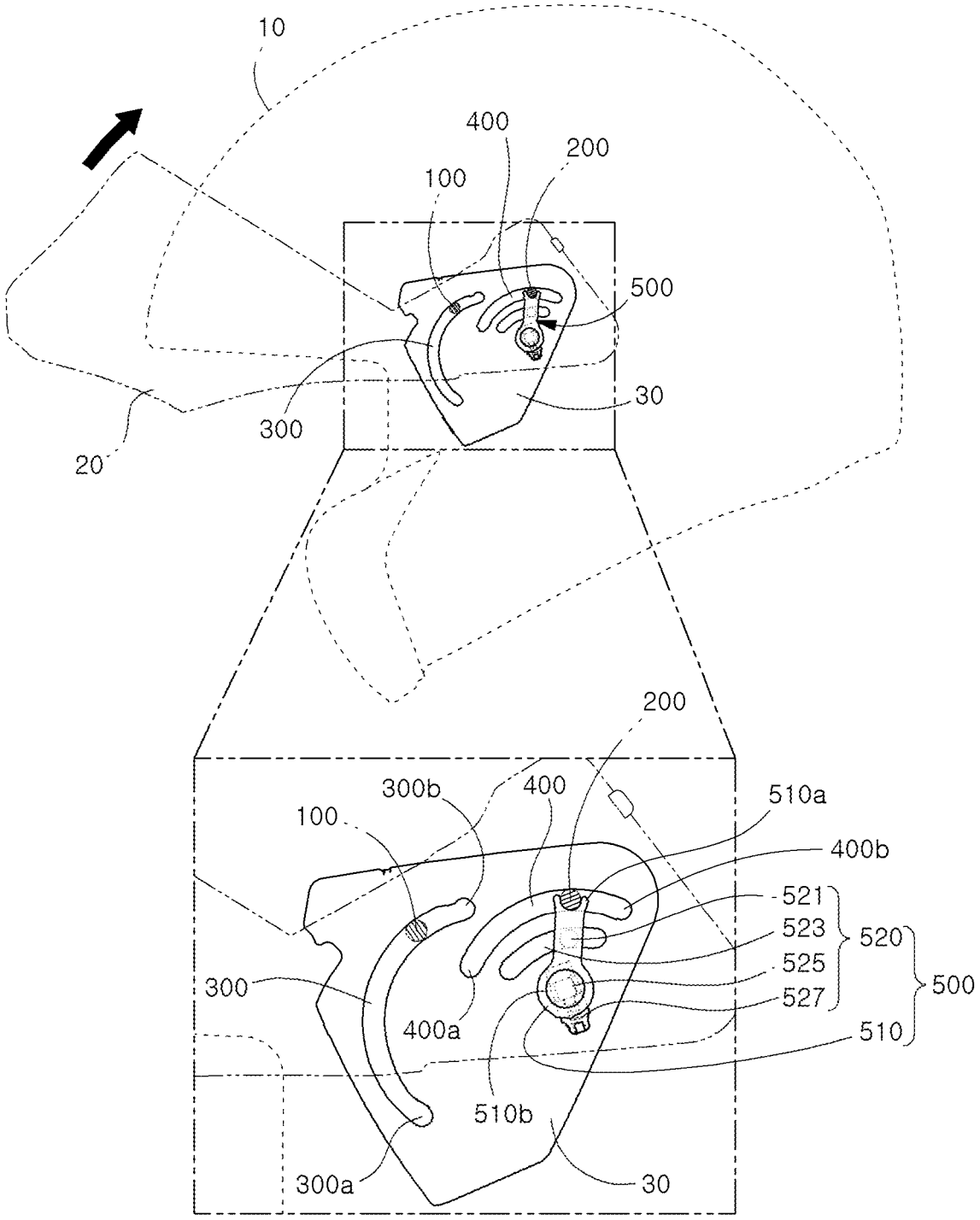
Figure 6:
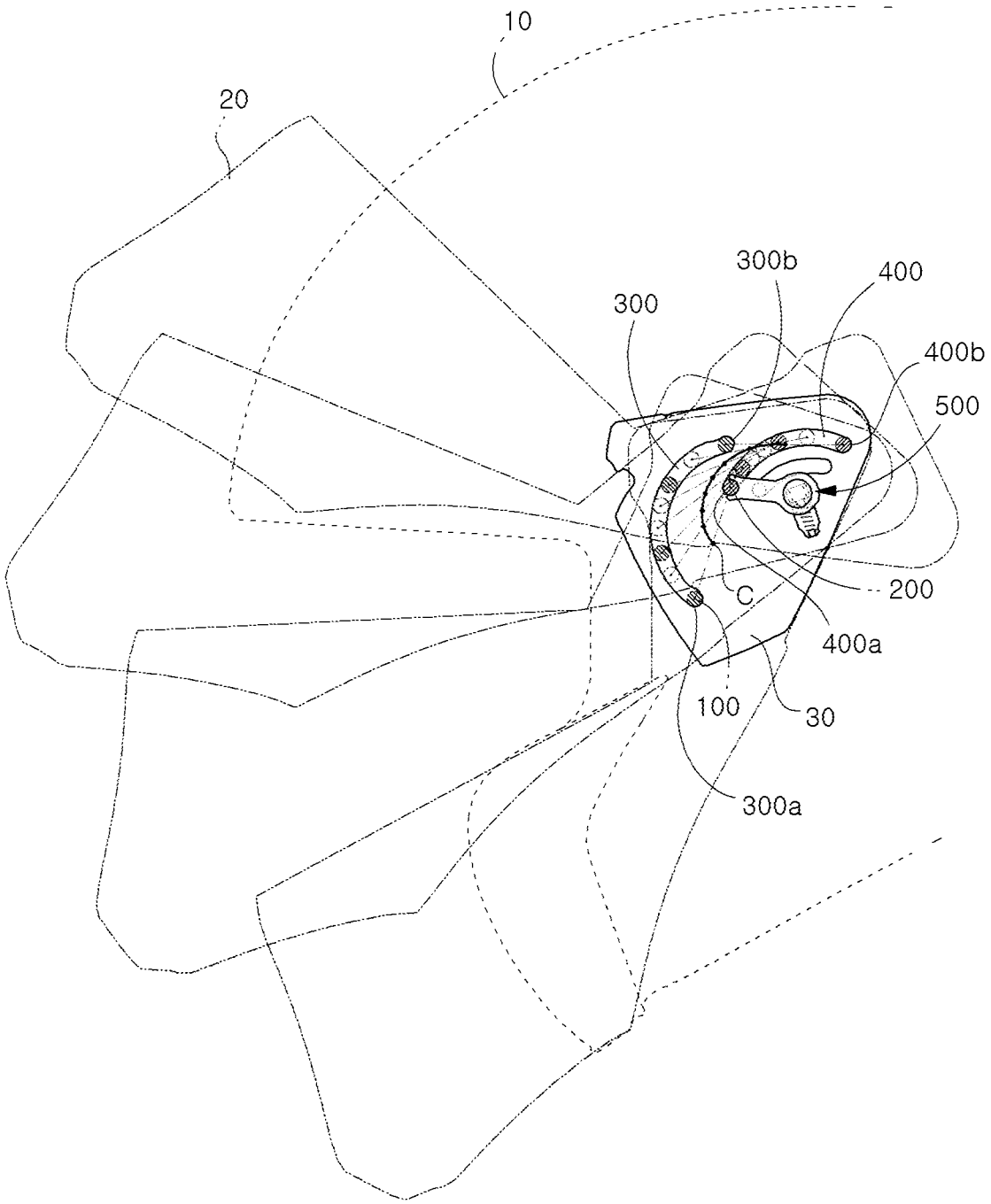
FIG. 6 is a side view showing the movement of a chin guard and first and second connection portions by the operation process of a chin guard pivoting mechanism according to an embodiment of the present disclosure.
Figure 7:
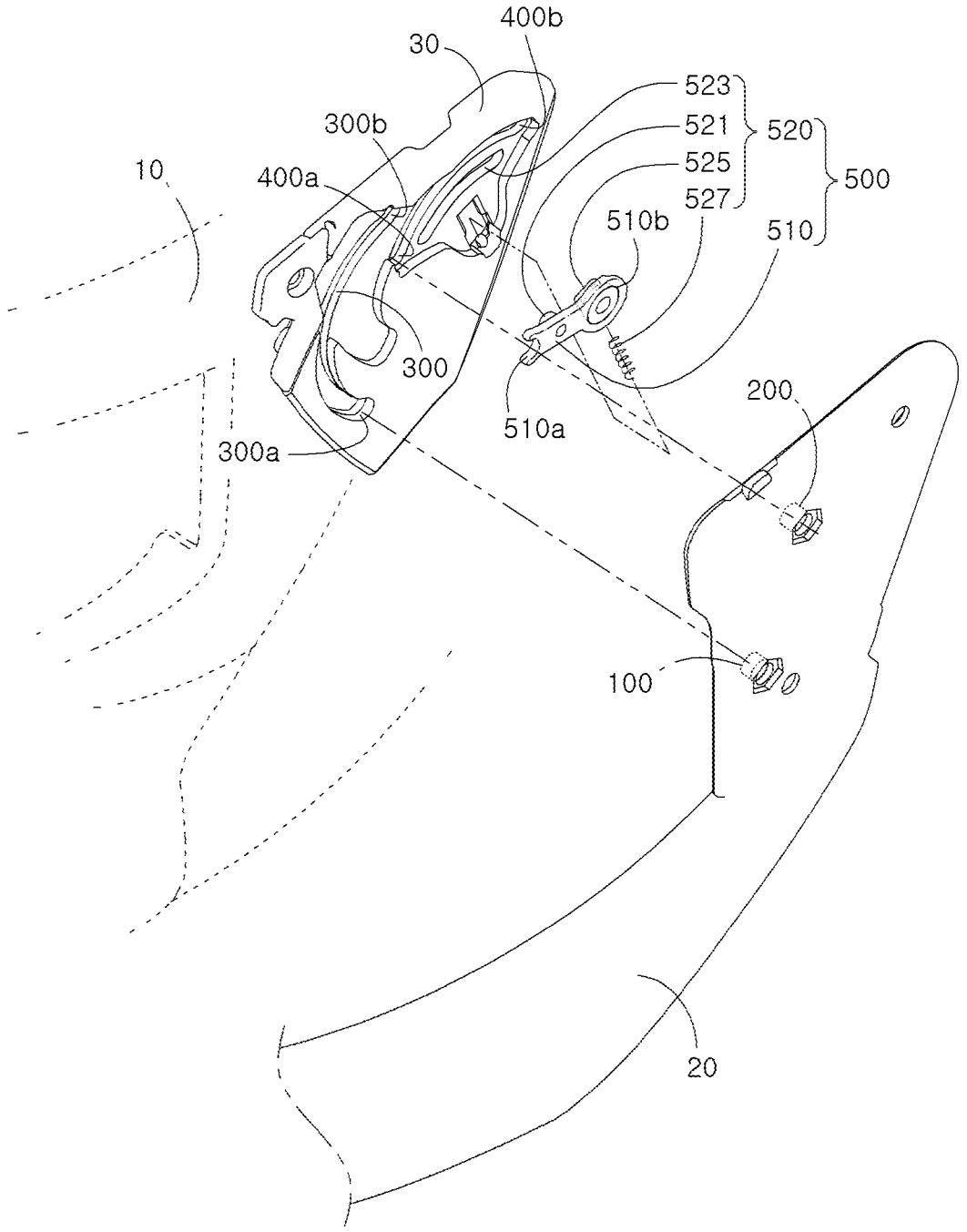
FIG. 7 is an exploded perspective view of a chin guard pivoting mechanism according to an embodiment of the present disclosure.
Figure 8:
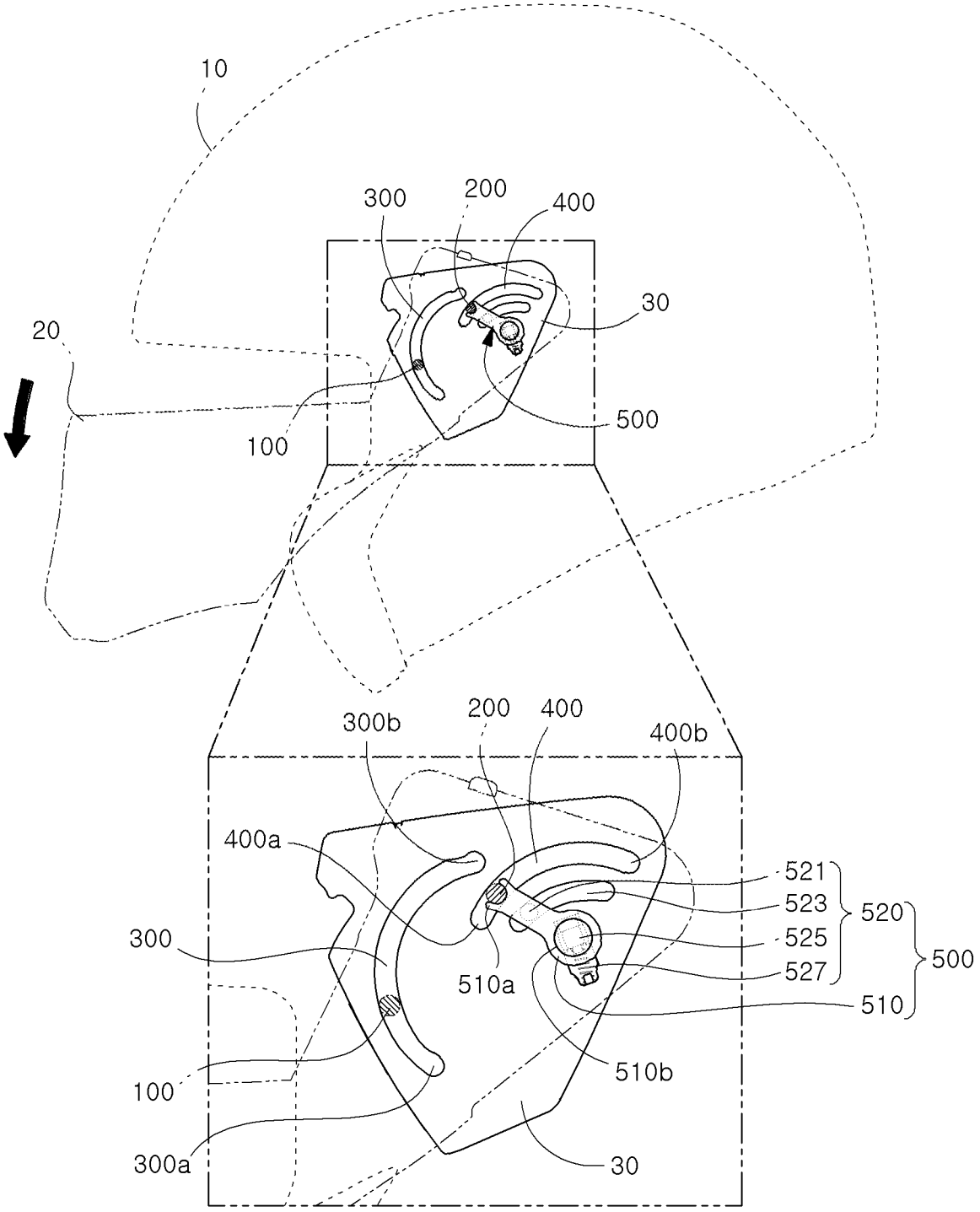
FIGS. 8 to 11 are side views showing another operation process of a chin guard pivoting mechanism according to an embodiment of the present disclosure.
Figure 9:
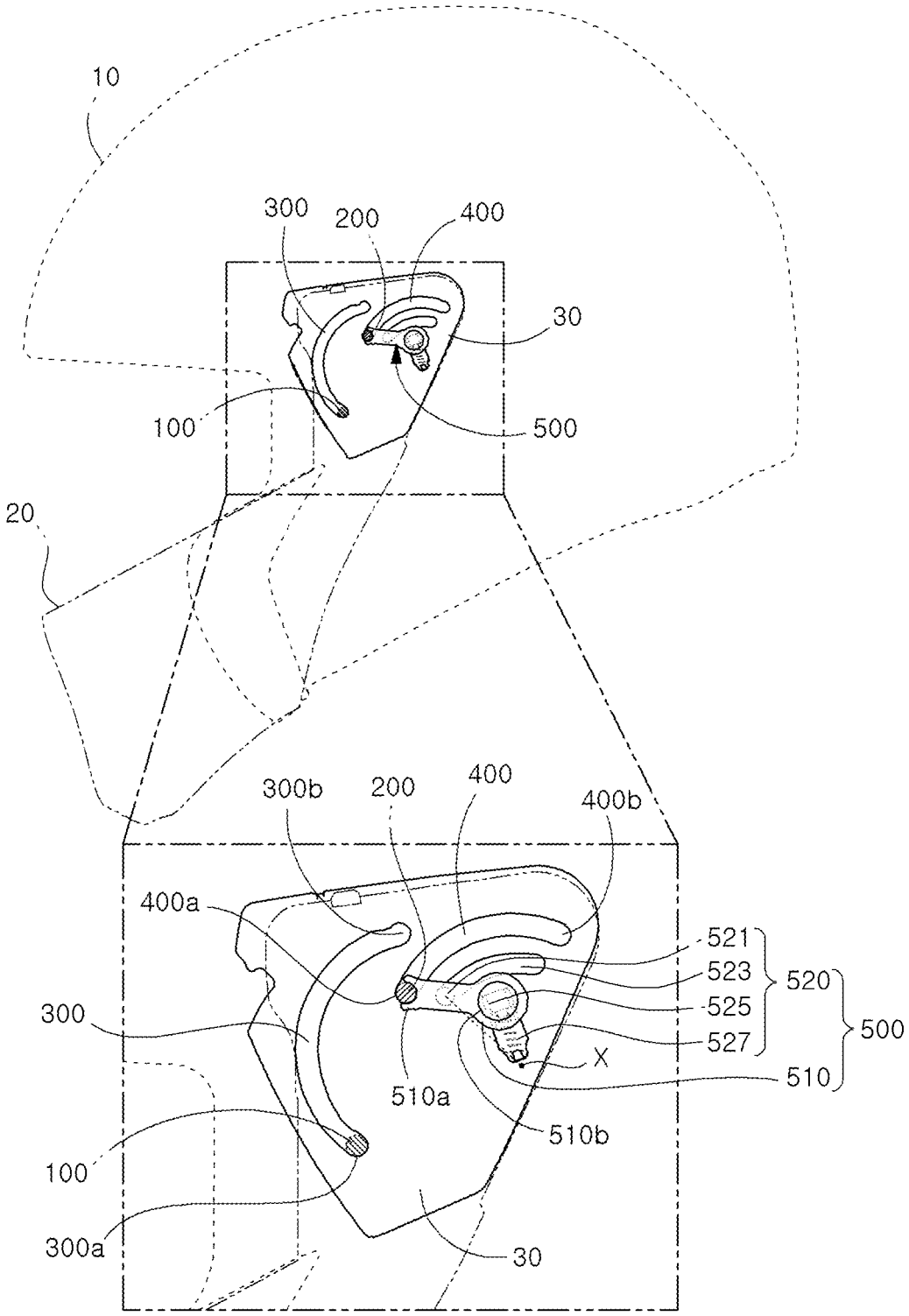
Figure 10:
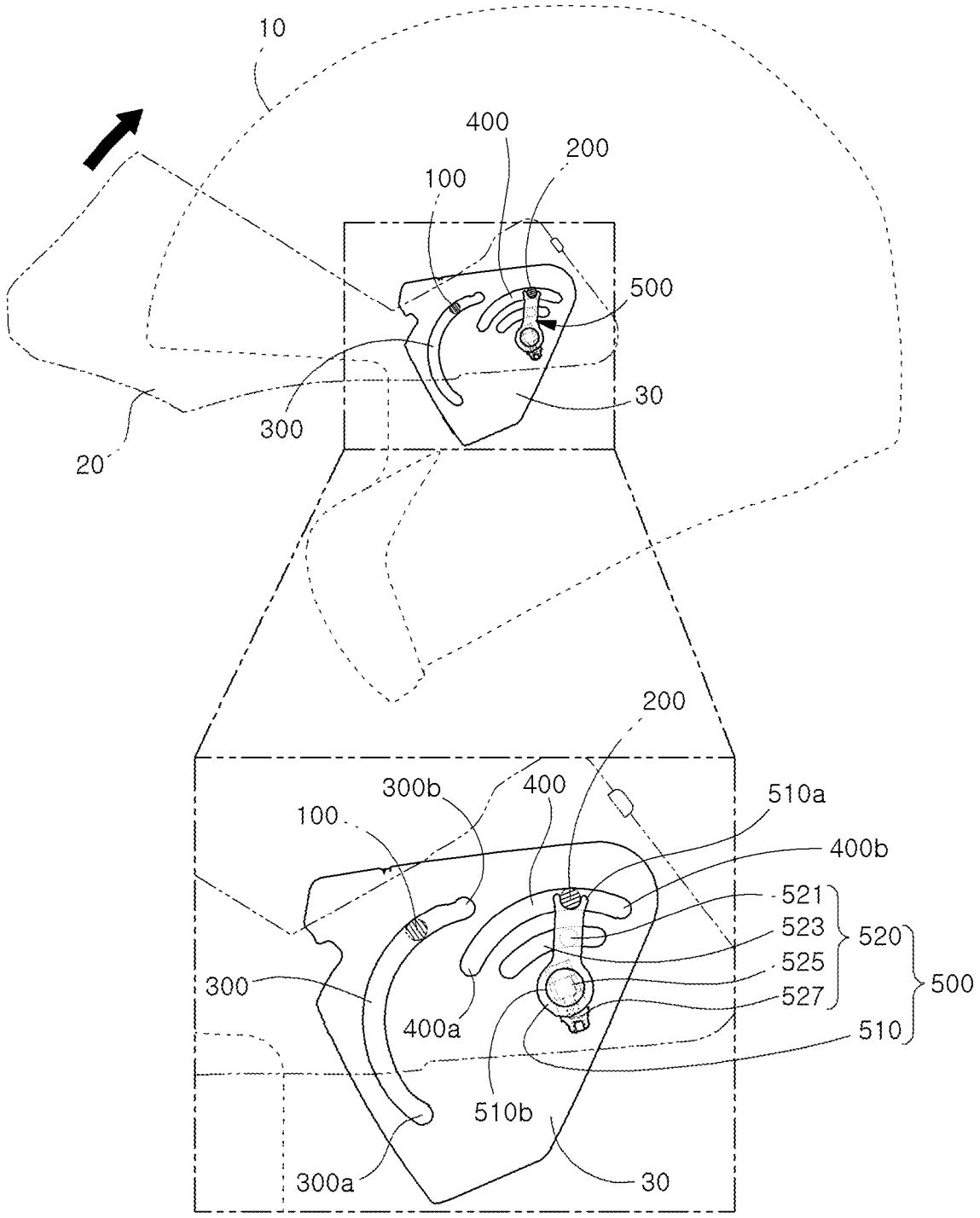
Figure 11:
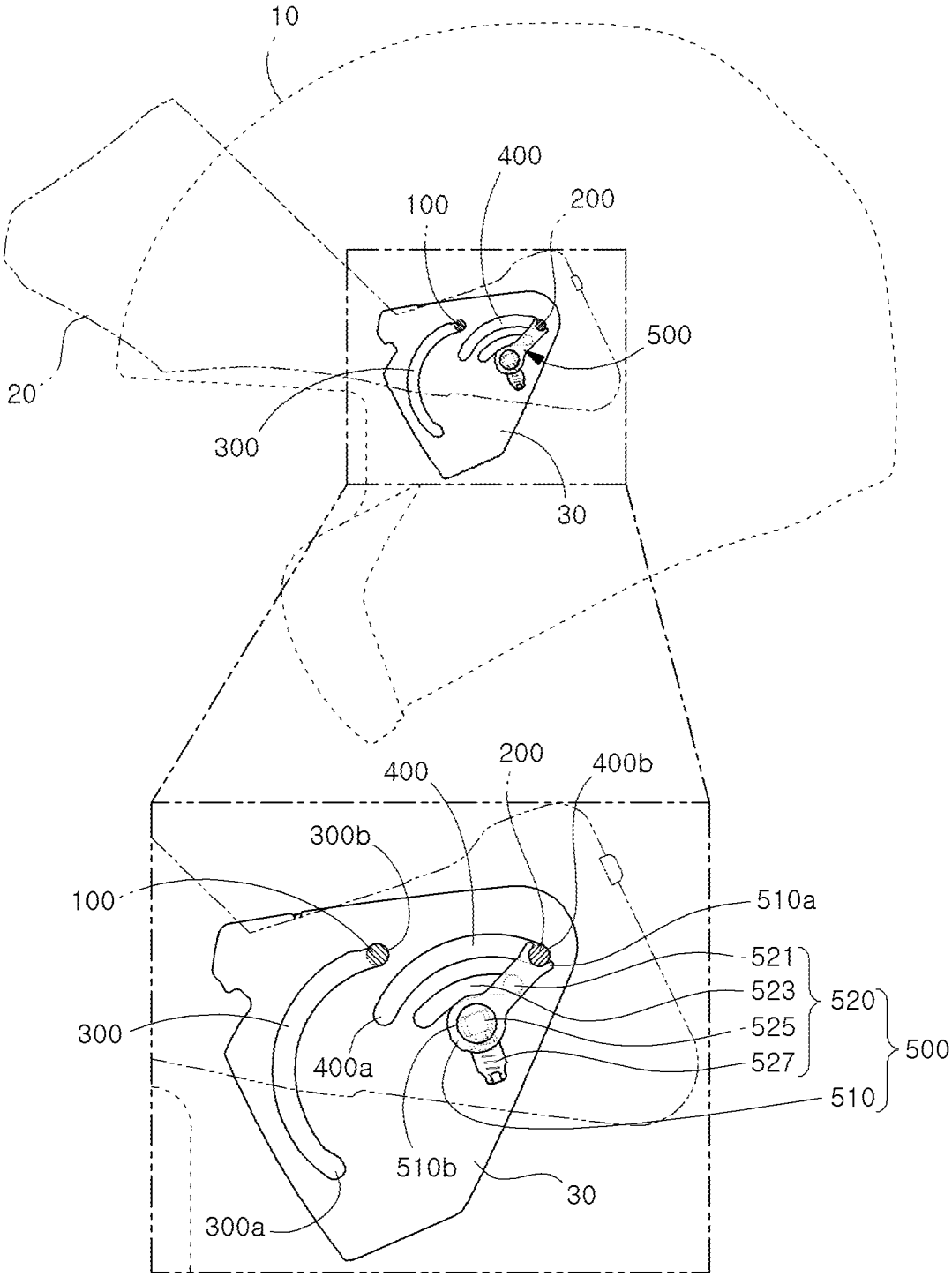

Subsequently, as shown in FIGS. 2 to 4, when the chin guard 20 pivots from the closed position to the open position, the first connection portion 100 moves from the first end 300*a* toward the second end 300*b* along the first guide portion 300, and the second connection portion 200 moves from the third end 400*a* toward the fourth end 400*b* along the second guide portion 400. In this instance, while the first connection portion 100 moves upward along the arc-shaped first guide portion 300 extended in the vertical direction, the second connection portion 200 may move rearward along the arc-shaped second guide portion 400 extended in the front-rear direction. As described above, because the second connection portion 200 moves rearward along the second guide portion 400, the chin guard 20 may be disposed as close to the helmet body 10 as possible. Specifically, as shown in FIG. 6, it can be seen that when a center of an imaginary line connecting the first connection portion 100 to the second connection portion 200 is defined as a center of pivot C of the chin guard 20, the extent to which a virtual curved line generated by the movement of the center of pivot C of the chin guard 20 protrudes frontward is smaller than the extent to which the first guide portion 300 protrudes frontward. As a result, as the chin guard 20 pivots from the closed position to the open position, the chin guard 20 may be disposed as close to the helmet body 10 as possible.

On the other hand, as the chin guard 20 pivots, the distance at which the first connection portion 100 moves along the first guide portion 300 may be larger than the distance at which the second connection portion 200 moves along the second guide portion 400. However, as the chin guard 20 goes from the closed position to the open position, a difference between the distance at which the first connection portion 100 moves along the first guide portion 300 and the distance at which the second connection portion 200 moves along the second guide portion 400 may reduce.

Figure 5:
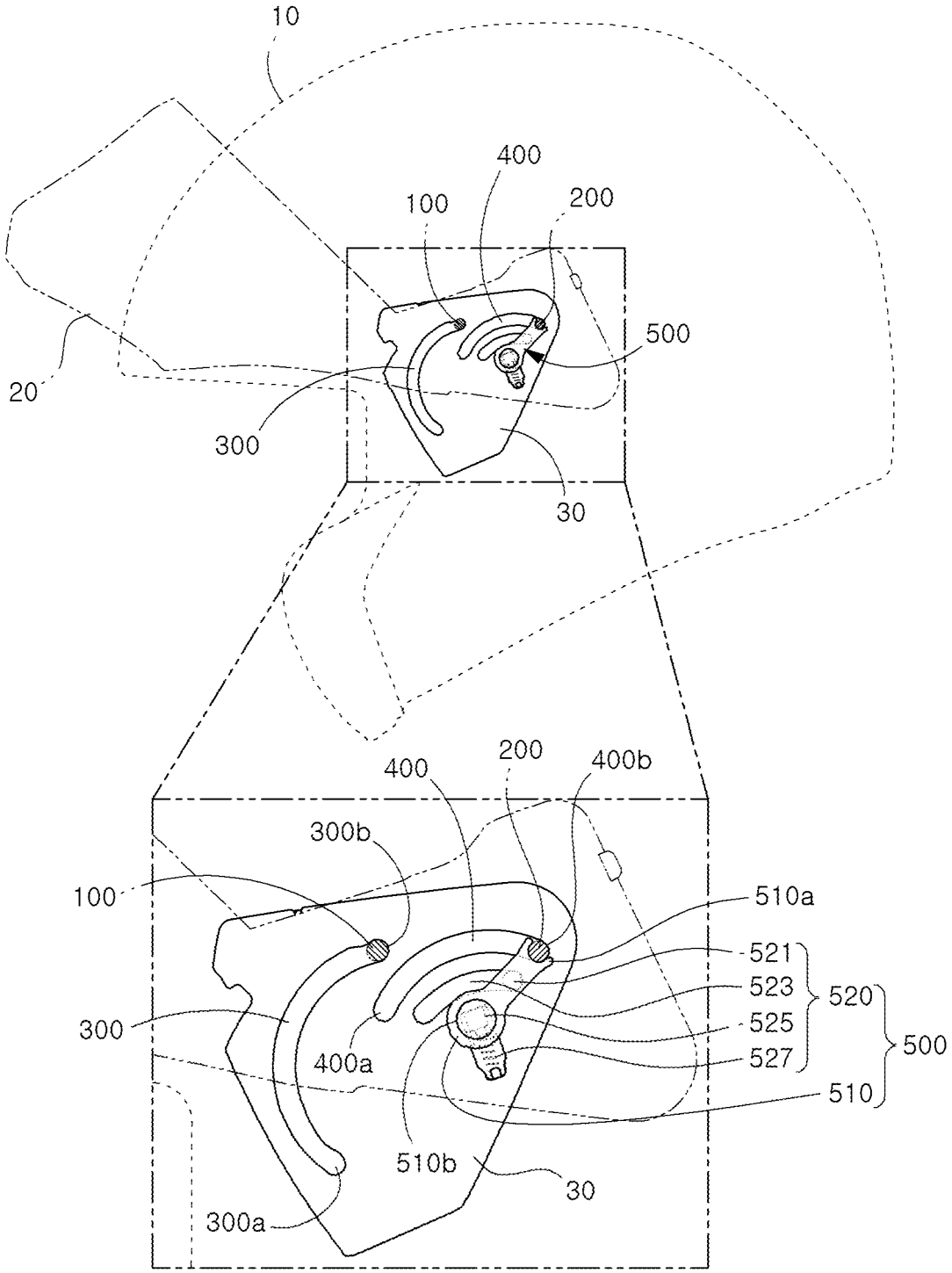

Finally, as shown in FIG. 5, when the chin guard 20 is disposed at the open position, the first connection portion 100 may be disposed at the second end 300*b* of the first guide portion 300, and the second connection portion 200 may be disposed at the fourth end 400*b* of the second guide portion 400.

MODE FOR INVENTION

On the other hand, as shown in FIGS. 7 to 11, when the second connection portion 200 moves along the second guide portion 400, a force providing portion 500 may be provided to provide the second connection portion 200 with a force toward the end (the third end 400*a* and the fourth end 400*b*) of the second guide portion 400. Here, the force providing portion 500 may be disposed on the inner side of the second guide portion 400, and may include a pivoting means 510 and a force providing means 520. In this instance, the pivoting means 510 may have one side 510*a* (one end) coupled to the second connection portion 200, and may pivot with respect to the other side 510*b* (the other end). For example, one side 510*a* (one end) of the pivoting means 510 may be formed in the shape of letter U that surrounds at least part of the second connection portion 200 and be coupled to the second connection portion 200, and the other side 510*b* (the other end) of the pivoting means 510 may be pivotably coupled to a movement portion 525 and act as a center of pivot of the pivoting means 510. Additionally, the force providing means 520 may be configured to provide the force to the pivoting means 510 so that one side 510*a* (one end) of the pivoting means 510 pivots toward the end (the third end 400*a*, and the fourth end 400*b*) of the second guide portion 400, and may include a third connection portion 521, a third guide portion 523, the movement portion 525 and an elastic portion 527. Here, the third connection portion 521 may be disposed in the pivoting means 510, and for example, may be formed in the shape of a protrusion that protrudes from the pivoting means 510. Additionally, when the pivoting means 510 pivots, the third guide portion 523 may guide the movement of the third connection portion 521, and may be extended at the ratchet portion 30 in an arc shape in parallel to the second guide portion 400. Additionally, the movement portion 525 may be coupled to the other side 510*b* (the other end) of the pivoting means 510 and configured to move so that the distance to the third guide portion 523 changes. For example, the movement portion 525 may be pivotably coupled to the other side 510*b* (the other end) of the pivoting means 510 and disposed to slide in the vertical direction with respect to the ratchet portion 30. Additionally, the elastic portion 527 provides an elastic force to the movement portion 525 in a direction of getting closer to the third guide portion 523. For example, the elastic portion 527 may be a compression spring, and as one end contacts the ratchet portion 30 and the other end contacts the movement portion 525, the elastic portion 527 may press the movement portion 525 toward the third guide portion 523.

When the pivoting means 510 pivots, the third connection portion 521 may slidably move along the third guide portion 523. In this instance, as the movement portion 525 and the pivoting means 510 are pressed toward the third guide portion 523 (upward direction) by the elastic portion 527, the force toward the end of the third guide portion 523 may be provided to the third connection portion 521 disposed in the pivoting means 510. More specifically, the other side (510*b*, the other end) of the pivoting means 510 may be closer to the third guide portion 523 than the center of curvature X (see FIG. 9) of the third guide portion 523. By this configuration, when the movement portion 525 and the pivoting means 510 are pressed toward the third guide portion 523 by the elastic portion 527, the force toward the end of the third guide portion 523 may be effectively provided to the third connection portion 521.

As described above, because the force toward the end of the third guide portion 523 is provided to the third connection portion 521 of the pivoting means 510, a force toward the end (the third end 400*a* and the fourth end 400*b*) of the second guide portion 400 disposed parallel to the third guide portion 523 is provided to the second connection portion 200 coupled to the pivoting means 510. Eventually, the force toward the end (the third end 400*a* and the fourth end 400*b*) of the second guide portion 400 may be also provided to the chin guard 20 by the second connection portion 200. Accordingly, as the chin guard 20 pivots, when the second connection portion 200 is disposed closer to the third end 400*a* than the fourth end 400*b* of the second guide portion 400 (see FIG. 8), the second connection portion 200 may move to the third end 400*a* by the elastic force of the elastic portion 527 and the chin guard 20 may pivot to the closed position (see FIG. 9). Additionally, when the second connection portion 200 is disposed closer to the fourth end 400*b* than the third end 400*a* of the second guide portion 400 (see FIG. 10), the second connection portion 200 may move to the fourth end 400*b* by the elastic force of the elastic portion 527 (see FIG. 11). To sum up, when the chin guard 20 is close to the closed position (see FIG. 8, when the second connection portion 200 is disposed closer to the third end 400*a* than the fourth end 400*b* of the second guide portion 400), the chin guard 20 may automatically pivot to the closed position (see FIG. 9). Additionally, when the chin guard 20 is close to the open position (see FIG. 10, when the second connection portion 200 is disposed closer to the fourth end 400*b* than the third end 400*a* of the second guide portion 400), the chin guard 20 may automatically pivot to the open position (see FIG. 11). Eventually, the chin guard pivoting mechanism according to this embodiment may semi-automatically pivot the chin guard 20 by employing the force providing portion 500.

In the foregoing description, the force providing portion 500 provides the second connection portion 200 with the force toward the end of the second guide portion 400, but is not limited thereto, and the force providing portion 500 may provide the first connection portion 100 with the force toward the end of the first guide portion 300. In this case, the force providing portion 500 may be disposed on the inner side of the first guide portion 300, one side of the pivoting means 510 may be coupled to the first connection portion 100, and the force providing means 520 may provide the force to the pivoting means 510 so that one side of the pivoting means 510 pivots toward the end of the first guide portion 300.

While the present disclosure has been hereinabove described in detail through the specific embodiments, this is provided to describe the present disclosure in detail, and the present disclosure is not limited thereto, and it is obvious that modifications or changes may be made by those having ordinary skill in the art within the technical spirit of the present disclosure.

Such modifications and changes of the present disclosure fall in the scope of the present disclosure, and the scope of protection of the present disclosure will be apparent from the appended claims.

| [Detailed Description of Main Elements] |
|---|
| 10: Helmet body |
| 20: Chin guard |
| 30: Ratchet portion |
| 100: First connection portion |
| 200: Second connection portion |
| 300: First guide portion |
| 300a: First end |
| 300b: Second end |
| 400: Second guide portion |
| 400a: Third end |
| 400b: Fourth end |
| 500: Force providing portion |
| 510: Pivoting means |
| 510a: One side of pivoting means |
| 510b: Other side of pivoting means |
| 520: Force providing means |
| 521: Third connection portion |
| 523: Third guide portion |
| 525: Movement portion |
| 527: Elastic portion |
| C: Center of pivot |
| X: Center of curvature of third guide portion |

INDUSTRIAL APPLICABILITY

The present disclosure provides the chin guard pivoting mechanism by which the chin guard may be disposed as closer to the helmet body as possible when the chin guard pivots to the open position.

The invention claimed is:

1. A chin guard pivoting mechanism provided in a helmet including a helmet body and a chin guard pivotably coupled to the helmet body, wherein as two connection portions disposed in the chin guard moves along two guide portions, the chin guard pivots, and at least one of the two guide portions is extended from the front to the rear, wherein the two connection portions include:

a first connection portion disposed in the chin guard; and a second connection portion disposed in the chin guard, wherein the two guide portions include:

a first guide portion disposed in the helmet body, and configured to guide the movement of the first connection portion when the chin guard pivots; and a second guide portion disposed in the helmet body, and configured to guide the movement of the second connection portion when the chin guard pivots, wherein when the first guide portion includes a first end and a second end, and the second guide portion includes a third end and a fourth end, the first end is disposed at a low position compared to the second end, and the third end is disposed at a front position compared to the fourth end, and wherein as the chin guard pivots, the first connection portion moves from the first end to the second end, and at the same time the second connection portion moves from the third end to the fourth end.

2. The chin guard pivoting mechanism according to claim 1, wherein each of the two guide portions is extended in an arc shape.

3. The chin guard pivoting mechanism according to claim 1, wherein the first guide portion is disposed at a front position compared to the second guide portion.

4. The chin guard pivoting mechanism according to claim 1, wherein when the chin guard pivots, a distance at which the first connection portion moves along the first guide portion is larger than a distance at which the second connection portion moves along the second guide portion.

5. The chin guard pivoting mechanism according to claim 1, wherein the third end is disposed closer to the second end than the first end.

6. The chin guard pivoting mechanism according to claim 1, wherein the first guide portion is formed in an arc shape that extends frontward and then rearward from the first end to the second end, and wherein the second guide portion is formed in an arc shape that extends upward and then downward from the third end to the fourth end.

* * * * *